United States Patent [19]

Taniuchi et al.

[11] Patent Number: 4,808,371

[45] Date of Patent: Feb. 28, 1989

[54] EXTERIOR PROTECTIVE MEMBER MADE OF AUSTENITIC STAINLESS STEEL FOR A SHEATHING HEATER ELEMENT

[75] Inventors: Toshihiko Taniuchi; Rikio Nemoto, both of Kawasaki; Yoshito Fujiwara, Chigasaki, all of Japan

[73] Assignee: Nippon Yakin Kogyo Co., Ltd., Tokyo, Japan

[21] Appl. No.: 83,234

[22] Filed: Aug. 10, 1987

[30] Foreign Application Priority Data

Nov. 10, 1986 [JP] Japan ..... 61-267411

[51] Int. Cl.[4] ..... C22C 38/50

[52] U.S. Cl. ..... 420/54; 420/584; 420/586

[58] Field of Search ..... 219/534, 544; 338/238-251; 420/54, 56, 584, 586, 585; 148/909, 327, 442

[56] References Cited

FOREIGN PATENT DOCUMENTS 48-73321 10/1973 Japan .

60-230966 10/1985 Japan ..... 420/54

*Primary Examiner*—Deborah Yee

*Attorney, Agent, or Firm*—Arnold S. Weintraub

[57] ABSTRACT

Particularly important properties required for exterior protective members for sheathing heaters are resistance to oxidation, anti-stress corrosion properties and weldability. An austenitic stainless steel for the exterior protective members has been developed from the findings that, firstly, the resistance to oxidation can be remarkably improved by increasing the Cr content together with a combined addition of Al and rare earth metals. Secondly, a small amount of Co addition is effective to enhance alloy ability to withstand stress corrosion cracking in the environment to which sheathing heaters are subjected, and that the weldability of such members can be made superior by maintaining the content of Si and Ti within a specified region.

6 Claims, 2 Drawing Sheets

EXTERIOR PROTECTIVE MEMBER MADE OF AUSTENITIC STAINLESS STEEL FOR A SHEATHING HEATER ELEMENT

BACKGROUND OF THE INVENTION

1. Field of the Invention:

This invention relates to an exterior protective member made of austenitic stainless steel for a sheathing heater element (heater) which is superior in oxidation resistance and anti-stress corrosion cracking and which has good weldability.

2. Prior Art:

In a so-called sheathing heater, a resistance heating element is covered, for protection, by a tubular protective member through a heat resistance electric insulating material, such as magnesium oxide. The protective member is hermetically sealed by means of welding. Since materials for such an exterior protective tubular member are required to have superior properties in oxidation resistance; resistance to stress corrosion cracking; and, also, good weldability, heretofore, high Ni heat resistance alloys such as NCF 800 and the like have widely been used.

High Ni heat resistant alloys of this type, however, have been found to have some drawbacks with respect to their insufficient performance in workability, weldability and too high a production cost for commercial use, though they have been proven to be considerably superior with respect to their resistance to oxidation as well as to stress corrosion cracking as explained above.

In order to obviate such drawbacks, as mentioned above, various proposals have been made.

For instance, Japanese Patent Publication No. 55(1980)-29146, proposes a protective member for electric heating members fabricated of a Fe-Ni-Cr alloy containing Cr, Ni, Si and Ce in a controlled and interrelated percentage with the intention to improve the alloy with regard to oxidation resistance property, resistance to stress corrosion cracking, weldability, but with reduced production cost.

Another proposal, Japanese Unexamined Patent Publication No. 48(1973)-13213, proposes a stabilized austenitic alloy steel free from forming welding cracks, and which aims at an economical production thereof by means of adjusting the content of Mn and Ti within a specified ratio depending on the amount of sulfur and phosphorus, respectively.

On the other hand, Japanese Patent Publication No. 57(1982)-19182 discloses an alloy having superior high temperature strength as well as good oxidation resistant property.

However, the protective member for an electric heating element disclosed by aforesaid Japanese Patent Publication No. 55-29146, has proven to be insufficient in oxidation resistance due to its low Cr content.

Speaking of the austenitic alloy steel disclosed in the above-mentioned Japanese Unexamined Patent Publication No. 48(1973)-13213, although there is found no disclosure therein about the properties, such as, oxidation resistance and resistance to stress corrosion cracking, the steel is supposed to be beyond expectation in its resistance to oxidation in view of the fact that the steel does not have added to it rare earth metals such as Ce or the like.

As to the alloys disclosed by the Japanese Patent Publication No. 57(1982)-19182, they have drawbacks with respect to weldability because of the fact that they contain too high an amount of Si.

By taking the above-mentioned drawbacks into account, the present invention aims to provide an exterior protective member for a sheathing heater made of austenitic stainless steels superior in the properties of oxidation resistance, resistance to stress corrosion cracking, weldability and yet can be fabricated with low production cost.

SUMMARY OF THE INVENTION

Particularly important properties required for exterior protective members are resistance to oxidation, stress corrosion cracking resistance and weldability. The inventors of the present invention have developed this invention from the following findings: Firstly, resistance to oxidation can be remarkably improved, as shown in FIG. 1, by increasing the Cr content together with a combined addition of Al and rare earth metals (hereafter merely referred to as REM). Secondly, a small amount of Co addition is effective to enhance the alloy to enable it to withstand stress corrosion cracking in the environment to which sheathing heaters are subjected and, that the weldability of such members can be made superior by maintaining the content of Si and Ti within a framed and hatched region as shown in FIG. 2.

In other words, the characteristic feature of the invention resides in that the material to be used consists essentially, all by weight, of about 19 to about 23% Ni; greater than about 23% but not more than 25% Cr; not more than 1% Mn; not more than 0.7% Si; not more than 0.3% Ti; not more than 0.03% C and the ratio Ti/C is to be kept greater than 5 inclusive; not more than 2% Co; not more than 0.3% Al; not more than 0.03% REM, and the balance being Fe and incidental impurities.

According to the present invention, the content of C as an austenite forming element is limited to not more than 0.03% by weight (hereafter the content of all alloying elements are expressed by weight %).

If the content of C exceeds this value, it will combine with Cr in the alloy of form Cr carbide or carbides and thereby deteriorates the alloy not only in its resistance to corrosion but also in its workability in forming.

Although Si is an important element for the alloy to display its resistance to oxidation, an excessive amount of Si over 0.7% is liable to bring about an adverse effect on the weldability of the alloy. Accordingly, the upper limit for Si content is specified to be 0.7%, and is preferably not more than 0.5% for improving weldability of the alloy.

Mn, if present in the alloy in an amount exceeding 1%, impairs the resistance of the alloy to oxidation, so the Mn content is specified to be not more than 1%.

Ti is an element which contributes to improve high temperature strength, corrosion resistance and particularly, intergranular corrosion resistance. However, if it is added over the specified range as shown in FIG. 2, it impairs the properties such as resistance to oxidation and weldability. So the amount of Ti is controlled to be not more than 0.3% and at the same time to maintain the ratio Ti/C not less than 5.

Ni is required to be present in an amount not less than 19% in order to maintain the stress corrosion cracking and to stabilize the microstructure of the alloy to prevent the precipitation of $\sigma$ phase from occurring. If the amount of Ni is less than the value, the property of the alloy against stress corrosion cracking would be greatly degraded. However, since excessive addition of Ni deteriorates weldability of the alloy, accompanied by increased production costs, the upper limit for Ni addition is set to be 25%, preferably within a range of 19 to 23%.

Since Cr displays, in cooperation with Si, a very important function in the property of resistance to oxidation and is remarkably effective when it is present outside the range shown in FIG. 1 due to its effect when combined with Al and REM. Cr must be contained in an amount exceeding 23%. On the other hand, an excessive amount of Cr over 25% is liable to deteriorate both hot workability and toughness of the alloy and promote $\sigma$ phase precipitation further. Consequently, Cr content, according to the present invention is specified to be more than 23% but not exceeding 25%.

Co is an effective element, similar to Ni, for its resistance to stress corrosion cracking and for stabilizing the microstructure of the material, and particularly for its resistance to stress corrosion cracking against neutral salts which are required for sheathing heaters of this kind.

When the alloy does not contain Co at all, it is required to contain more than 25% Ni. While the amount of Ni over 19% will be sufficient if Co is contained in the alloy, since too large an amount of Co increases production costs, content of Co is specified to be not more than 2%.

Addition of Al of 0.05% or more in cooperation with REM remarkably improves the property of resistance to oxidation as shown in FIG. 1. However, if excess Al is added over its upper limit it degrades hot workability, formability and weldability of the obtained alloy steel. So the upper limit of Al addition is specified to be 0.3%.

REM, for instance Ce, when added in combination with Al enhances the resistance to oxidation of the steel but only when the REM exists as trace elements. Excess amounts of REM rather impair hot workability and cleanliness of the obtained steel. Accordingly, addition of REM is specified to be not more than 0.03%.

For a more complete understanding of the present invention reference is made to the following detailed description and drawings.

EXAMPLES

Figure 1:
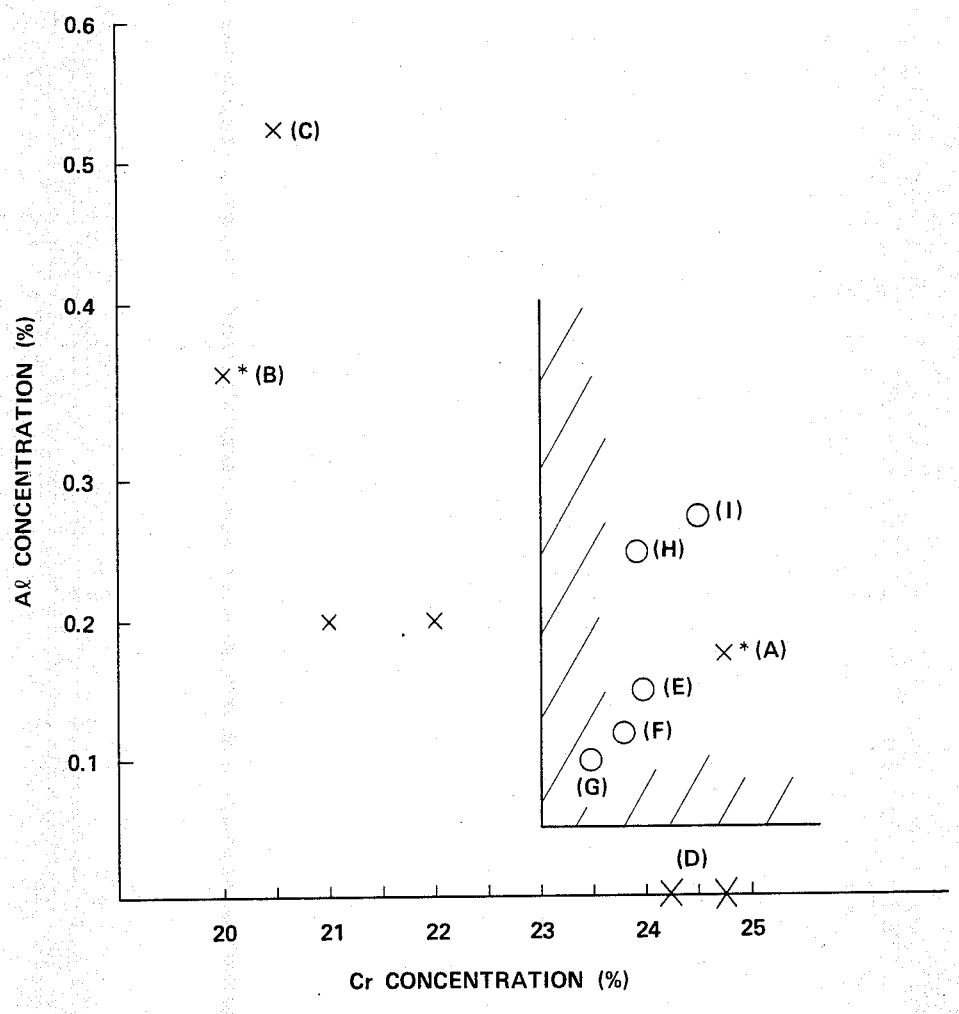
FIG. 1 is a drawing showing the effect of added Cr. Al and REM on the resistance of the alloy to oxidation in comparison with other alloys.
Figure 2:
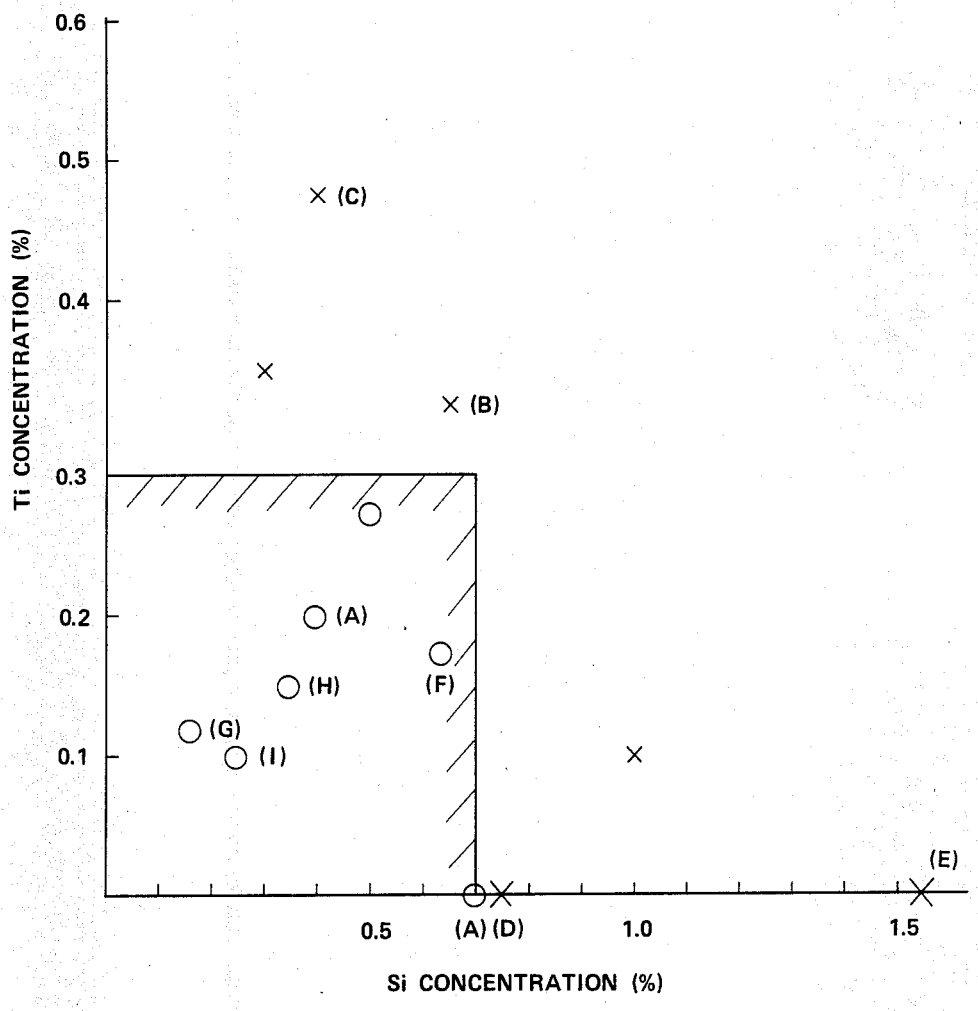
FIG. 2 is a graph showing the effect of added Si and Ti on the weldability of the present alloy in comparison with other steels.

Explanation will now be made hereafter to several working examples of the present invention in comparison with several alloys having other chemical compositions.

Table 1 shows the chemical composition of each stainless steel under subject. In the table all shown percentages are by weight.

Symbols A, B, C, D and E denote five kinds of comparative steels each of which is prepared to have a different composition from each other. While symbols F, G, H and I denote four kinds of steel each prepared to have chemical composition satisfying the specified value for the present invention.

TABLE 1

| | C | Si | Mn | Ni | Cr | Al | Ti | REM | Co | Ti/C |
|---|---|---|---|---|---|---|---|---|---|---|
| Comparative Steels | | | | | | | | | | |
| A | 0.053 | 0.70 | 1.84 | 19.80 | 24.71 | 0.15 | — | — | — | 0 |
| B | 0.065 | 0.67 | 0.98 | 32.64 | 19.93 | 0.36 | 0.34 | — | — | 5.2 |
| C | 0.062 | 0.38 | 0.78 | 18.64 | 20.94 | 0.53 | 0.47 | 0.033 | — | 7.6 |
| D | 0.025 | 0.72 | 1.02 | 18.50 | 24.30 | — | — | 0.025 | — | 0 |
| E | 0.041 | 1.52 | 0.50 | 17.30 | 23.82 | 0.15 | — | 0.011 | 0.21 | 0 |
| Inventive Steels | | | | | | | | | | |
| F | 0.024 | 0.65 | 0.43 | 20.97 | 23.67 | 0.11 | 0.17 | 0.026 | 0.28 | 7.1 |
| G | 0.017 | 0.16 | 0.30 | 19.46 | 23.50 | 0.10 | 0.12 | 0.006 | 0.20 | 7.0 |
| H | 0.021 | 0.32 | 0.49 | 20.17 | 23.85 | 0.25 | 0.15 | 0.021 | 0.31 | 7.1 |
| I | 0.020 | 0.22 | 0.48 | 21.32 | 24.51 | 0.26 | 0.11 | 0.005 | 1.12 | 5.5 |

Each of the alloys denoted as A through I mentioned above was melted in an induction furnace under open air and cast into an ingot of about 10 kg weight. Then these ingots were hot forged, as plates, each having a thickness of about 10 mm. Then these plates were subjected to hot rolling and subsequent cold rolling and, finally, they were formed as plates of 2 mm thick.

These plates were cut into thin plate specimens to be used for oxidation resistance test, corrosion test and U-bend stress corrosion test. These thin test specimens were heat treated at a temperature of 1100° C. for 10 minutes to be used for respective testing.

On the other hand, test specimens for evaluation weldability were cut out from the above-mentioned ingots into specimens having a thickness of 10 mm.

Oxidation tests were conducted on each specimen prepared from the test materials of A through I and the results of the tests were evaluated after having subjected the specimens to repeated cyclic heating and cooling of 500 times with one cycle consisting of 30 minutes heating at 1000° C. in open air followed by air cooling for 10 minutes.

Stress corrosion cracking (SCC) tests were conducted by using U-bend type specimens and dipping the specimens into boiling solution (20% NaCl + 1% $Na_2Cr_2O_7.2H_2O$) for 480 hours (20 days) and, then, each specimen was examined for the presence of cracking.

The weldability of respective specimens was evaluated by inspecting whether there had been formed any weld cracks on the specimen subjected to TIG arc spot welding.

The specimens for evaluation intergranular corrosion were heat-treated at 650° C. for 2 hours and subsequently immersed into a boiling solution of copper sulfate-sulfuric acid for 16 hours. Then they were taken out of the solution and subjected to a 180 degree bending test to inspect for the presence of cracking.

Table 2 shows the summary of these test results.

TABLE 2

| | Oxidation Test ($mg/cm^2$) | SCC Test | Weld-ability | Intergranular Corrosion Test |
|---|---|---|---|---|
| Comparative Steels | | | | |
| A | −90 | x | o | x |
| B | −47 | o | x | o |
| C | −85 | x | x | o |
| D | −73 | x | x | x |
| E | −4 | x | x | x |
| Inventive Steels | | | | |
| F | 0 | o | o | o |
| G | −4 | o | o | o |
| H | −4 | o | o | o |
| I | −5 | o | o | o |

Remarks: o: No crack, x: Cracks(s) formed

The marks o and x in the table indicate no crack or cracks in the specimens, respectively.

The following facts were revealed through these tests.

(1) Resistance to oxidation:

FIG. 1 shows the interrelation between Cr, Al and REM with respect to their effect on the resistance to oxidation of each steel.

In FIG. 1, the axis of abscissa represents Cr contents and the axis of ordinate shows Al content and each point is shown with sample symbol A through I.

Symbols with an asterisk indicate the specimens containing no REM, while all the remaining specimens contained not more than 0.03% REM.

The hatched area in the graph shows a region wherein high extent of oxidation resistance has been attained due to REM, while the specimens outside the area revealed a low extent of resistance to oxidation.

As can be clearly seen in FIG. 1 and Table 1, steel specimens having inferior resistance to oxidation were found to be (a) the comparative steel A of high Cr content and bearing Al but having no REM, (b) the comparative steel B having low Cr content and bearing Al but having no REM, (c) the comparative steel C containing both Al and REM but having low Cr and (d) the comparative steel D of high Cr content and bearing REM but having no Al.

On the other hand, the stainless steels F through I according to the present invention containing high amounts of Cr exceeding 23% and further having incorporated therewithin the combined addition of Al have revealed superior resistance to oxidation.

(2) Resistance to Stress Corrosion Cracking:

The steels having inferior resistance to stress corrosion cracking were cobalt free comparative steels A, C and D and the comparative steel E which contains Co, but containing less than 19% Ni.

On the other hand, inventive steels F through I containing 19% or more of Ni together with Co addition and the comparative alloy B containing a high amount of Ni were proved to be superior in resistance to stress corrosion cracking.

(3) Weldability:

Steels inferior in weldability were proved to be comparative steels B and C containing Ti in excess of 0.3% and comparative steels D and E containing Si more than 0.7%.

On the other hand, all the inventive steels F through I were proved to have superior weldability.

(4) Intergranular Corrosion Resistance:

The steels poor in this property were found to be comparative steels A, D and E in which the Ti/C ratio was 5 or less, while all the inventive steels have revealed superior intergranular corrosion resistance.

As can be clearly seen from the above-mentioned test results, chemical composition according to the present invention is specified to contain Cr more than 23% but not exceeding 25%, Al, Ti and REM within a specified respective range and further contain an optimum amount of Ni, Si and Ti. By virtue of the present invention an exterior protective member for sheathing heaters having a low production cost can be made from austenitic stainless steel having superior properties in oxidation resistance, stress corrosion cracking resistance and weldability.

We claim:

1. The exterior protective member for sheathing heaters made of an austenitic stainless steel consisting of, by weight, 19 to 23% Ni, from greater than 23% but not more than 25% Cr, not more than 1% Mn, not more than 0.7% Si, not more than 0.3% Ti, not more than 0.03% C, not more than 2% Co., not more than 0.3% Al, not more than 0.03% REM and the balance being Fe and incidental impurities and wherein the Ti/C ratio is more than 5.

2. The exterior protective member of claim 1, wherein said Si is not more than 0.5%.

3. The exterior protective member of claim 1, wherein said Al is at least 0.05%.

4. The exterior protective member of claim 1, wherein said Co is at least 0.20%.

5. The exterior protective member of claim 1, wherein said REM is at least 0.005%.

6. An exterior protective member for sheathing heaters made of an austenitic stainless steel consisting essentially of, by weight, from greater than 19 but not more than 23% Ni, from greater than 23% but not more than 25% Cr, not more than 1% Mn, not more than 0.7% Si, not more than 0.3% Ti, not more than 0.03% C, from greater than 0.20% but not more than 2% Co, from greater than 0.05% but not more than 0.3% Al, from greater to 0.005% but not more than 0.3% REM, and the balance being Fe and incidental impurities, and wherein the Ti/C ratio is more than 5.

* * * * *